US008910619B2

(12) United States Patent
Gingrich et al.

(10) Patent No.: US 8,910,619 B2
(45) **Date of Patent: *Dec. 16, 2014**

(54) ENHANCED COMBUSTION FOR SPARK IGNITION ENGINE USING ELECTROMAGNETIC ENERGY COUPLING

(75) Inventors: Jess W. Gingrich, San Antonio, TX (US); Terrence F. Alger, II, San Antonio, TX (US); Charles E. Roberts, Jr., Helotes, TX (US)

(73) Assignee: Southwest Research Institute, San Antonio, TX (US)

( * ) Notice: Subject to any disclaimer, the term of this patent is extended or adjusted under 35 U.S.C. 154(b) by 474 days.

This patent is subject to a terminal disclaimer.

(21) Appl. No.: 13/283,059

(22) Filed: Oct. 27, 2011

(65) Prior Publication Data

US 2013/0104862 A1 May 2, 2013

(51) Int. Cl.

| | |
|---|---|
| ***F02P 3/02*** | (2006.01) |
| ***F02P 23/00*** | (2006.01) |
| ***F02P 23/04*** | (2006.01) |
| *F02M 27/04* | (2006.01) |

(52) U.S. Cl.

CPC ..... *F02P 23/045* (2013.01); *F02M 2027/047* (2013.01)

USPC ..... 123/620; 123/536; 123/298; 123/143 B; 123/668

(58) Field of Classification Search

CPC ..... F02B 51/08; F02P 3/02; F02P 23/00; F02P 23/045; F02P 9/007; F02M 2027/047

USPC ..... 123/668, 298, 143 B, 620, 536

See application file for complete search history.

(56) References Cited

U.S. PATENT DOCUMENTS

| | | | | |
|---|---|---|---|---|
| 8,365,707 | B2 * | 2/2013 | Ikeda | 123/536 |
| 8,485,162 | B2 * | 7/2013 | Ikeda | 123/536 |
| 8,495,989 | B2 * | 7/2013 | Ikeda | 123/536 |
| 8,499,746 | B2 * | 8/2013 | Ikeda et al. | 123/536 |
| 2012/0240873 | A1 * | 9/2012 | Ikeda | 123/3 |
| 2013/0104861 | A1 * | 5/2013 | Roberts et al. | 123/594 |

FOREIGN PATENT DOCUMENTS

| | | | | |
|---|---|---|---|---|
| WO | WO 2013/021993 | * | 2/2013 | F02P 23/04 |

* cited by examiner

*Primary Examiner* — Hai Huynh

(74) *Attorney, Agent, or Firm* — Chowdhury & Georgakis PC; Ann C. Livingston

(57) ABSTRACT

A method of improving the combustion of a spark-ignition internal combustion engine. Such engines have at least one cylinder, each cylinder having a compression chamber and operated such that an air-fuel mixture introduced into the combustion chamber is ignited to cause a combustion event. An antenna is placed within the combustion chamber, and is used to apply electromagnetic energy to the combustion.

17 Claims, 2 Drawing Sheets

ENHANCED COMBUSTION FOR SPARK IGNITION ENGINE USING ELECTROMAGNETIC ENERGY COUPLING

TECHNICAL FIELD OF THE INVENTION

This invention relates to spark-ignition internal combustion engines, and more particularly to enhancing combustion for such engines by applying electromagnetic energy to the combustion flame.

BACKGROUND OF THE INVENTION

Dilute operation of internal combustion engines through lean fueling and/or high levels of exhaust gas recirculation (EGR) is frequently employed to increase fuel efficiency and reduce emissions. In particular, for spark-ignition engines, dilute operation is a promising approach for increasing engine efficiency, in the form of either lean burn (air dilution) or EGR (inert dilution).

In the case of spark-ignition engines, primary limitations of dilute combustion are due to poor flame speed and flame growth instability. Various methods have been developed to reduce these limitations, such as enhanced ignition systems and charge motion improvements. Intake charge composition modifications, either through fuel reforming for lean dilution applications or exhaust reforming for EGR applications, has also been shown to improve dilute combustion by improving thermal efficiency.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to methods of enhancing dilute combustion in a spark-ignition engine using electromagnetic radiation. A microwave emitter (antenna) is placed within the combustion chamber and irradiates the air-fuel mixture (including any diluents such as EGR) in the chamber.

An air-fuel mixture enters the cylinder and is ignited by a spark plug (or other igniter). The flame travels outwards from the spark to the cylinder liner. Once the flame has been created by the ignition process, the combustion chamber is radiated with electromagnetic energy. In this manner, electromagnetic energy is directly coupled to the flame front. The method described herein is used to enhance flame propagation, not to initiate combustion.

The microwave region of the electromagnetic spectrum is of primary interest due to its inherent ability to interact directly with plasma. Microwave generation, transmission and other related system components are used in other industries and can be adapted for use in this application.

Electromagnetic energy can be coupled to the flame front due to the existence of combustion ions in this region. Oxidation of fuel and combustion gases is improved. Adding energy to the flame front in the form of an alternating current electric field can enhance reaction rates with a net result of faster flame speeds and more complete combustion. The combination of dilute engine operation and application of electromagnetic energy to the combustion process can also result in reduced pollutants.

Figure 1:
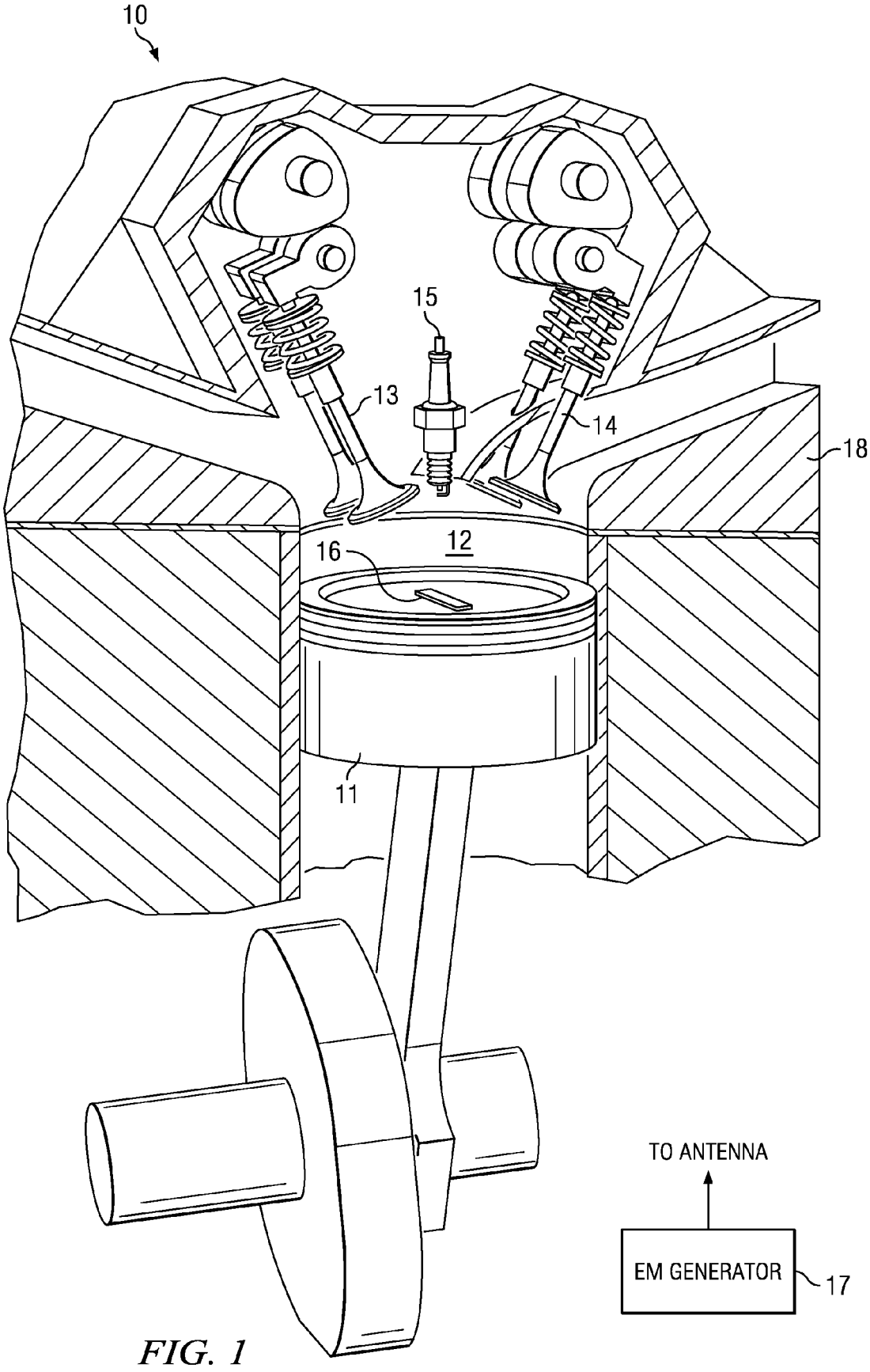
FIG. 1 illustrates a cylinder of a spark-ignition engine, the piston having an antenna for application of electromagnetic energy.

FIG. 1 illustrates a typical engine cylinder 10 of a spark-ignition internal combustion engine, the cylinder 10 having a reciprocating piston 11 and related components. The engine may be four-stroke or two-stroke, and in either case, there is a "combustion event" in which an air-fuel mixture is introduced into the combustion chamber by injection or otherwise. The mixture is ignited within the cylinder's combustion chamber (including equivalently a pre-chamber) by a spark plug or other igniter.

In particular, relevant to this description, FIG. 1 illustrates the components that bound the volume of the combustion chamber 12. During the combustion event, the intake valve 13 and exhaust valve 14 are closed, which fully isolates the combustion volume. The spark plug 15 delivers a spark into the combustion volume at the appropriate time as determined by the engine control strategy. The top of piston 11 closes against a fire deck 18 below the valves.

The inner wall of the combustion chamber 12 is nearly fully reflective to microwave radiation. This permits electromagnetic energy to be concentrated inside the combustion chamber 12 before and during the combustion process.

For implementation of the above-described method, an antenna 16 is placed in the combustion chamber to transmit the electromagnetic energy. In the embodiment of FIG. 1, antenna 16 is embedded into the top of piston 11 such that its field radiates outward from the top of the piston 11. Antenna 16 is electrically isolated from the surrounding material of the top of the piston. As explained below in connection with FIGS. 2 and 3, in other embodiments, antenna 16 may be placed in other locations in the combustion chamber 12.

Electromagnetic generator 17 is in electrical connection with the antenna 16, and located outside the combustion chamber 12. Electromagnetic generator 17 can be a fixed frequency generator, such as a magnetron that converts electricity into microwave energy. At some time near the combustion event, (just before, during or just after the combustion event), it provides a burst or continuous output of electromagnetic energy to antenna 16.

As explained below, in more sophisticated embodiments, electromagnetic generator 17 may be capable of generating electromagnetic energy at more than one frequency. Devices and methods for generating and transmitting microwave energy can include devices and methods that are known or to be developed in the field of consumer appliances and communications.

The internal geometry of the combustion chamber 12 can be designed to match the characteristic lengths of radiation from antenna 16 in three-dimensional space. In this manner, regions of superposition with intense field strength can be created. The combustion chamber 12 can act as a resonant cavity for electromagnetic energy. Its geometry can be further tuned so that the regions of high intensity are located where the enhanced flame will be most beneficial to overall combustion. This is typically near the flame kernel or the crevice volumes.

Also, the electromagnetic frequency can be tuned to the combustion chamber 12. More specifically, the frequency of the electromagnetic radiation can be tuned to match the changing distance between the antenna 16 and the primary reflecting surface. For example, if the antenna 16 is in the top of piston 11, the frequency can be tuned for the distance to the intake valve or cylinder head. As the combustion chamber's dimensions change during the compression and expansion stroke, the electromagnetic energy can be adjusted to maintain constructive interference (resonance) at the regions of importance for combustion enhancement.

The electromagnetic energy can be continuous or pulsed. Electromagnetic generator 17 can include a control unit to tune, phase, and modulate the electromagnetic energy throughout the combustion period where the flame is growing. The microwave energy may be delivered to the flame as it is combusting or to post-combustion gases, or both. As the flame grows, the resonance nodes at different locations in the combustion chamber may be desired, and the control unit can be programmed or electrically designed to tune frequency or geometry accordingly.

Figure 2:
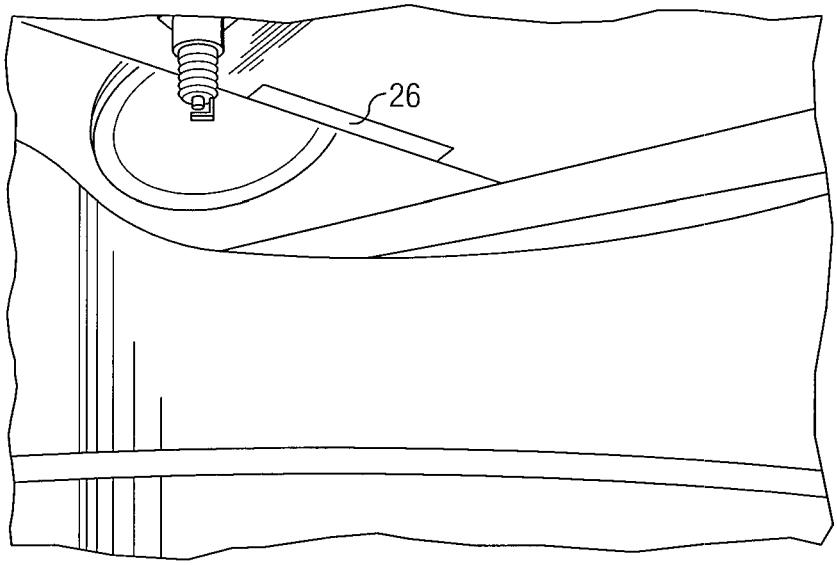
FIG. 2 illustrates how the antenna may be alternatively placed on the cylinder fire deck.
Figure 3:
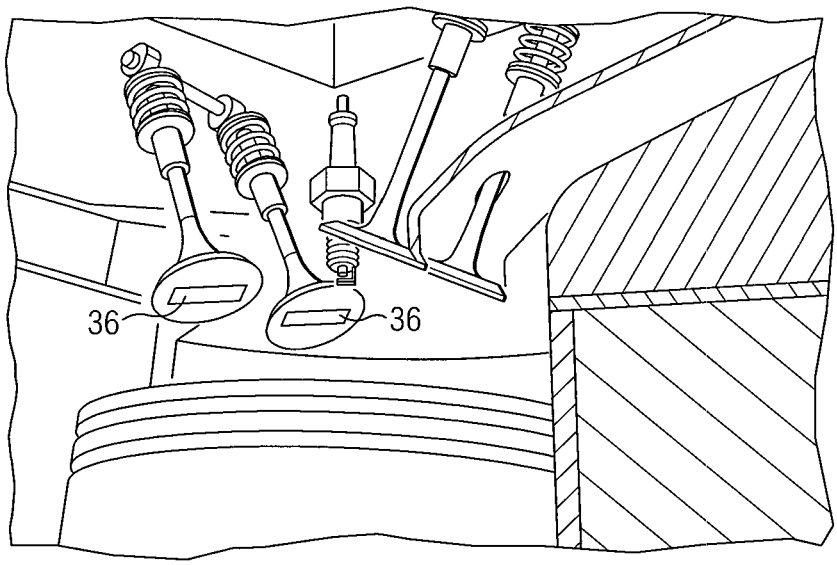
FIG. 3 illustrates how the antenna may be placed on a valve.

FIGS. 2 and 3 illustrate alternative placements of the antenna. Antennas 26 and 36 are located on the cylinder's fire deck or on a valve, respectively. In the example of FIG. 3, the antenna 36 is located on the bottom of the plug (disk-shaped) portion of the valve.

As indicated above, the antenna may be located anywhere inside the combustion chamber that best suits the combustion chamber geometry. For purposes of this description, the antenna may be on or integrated with various surfaces internal to the combustion chamber, regardless of the method of attachment of the antenna, by embedding or affixing or otherwise. It may also be desirable to use more than one antenna.

What is claimed is:

1. A method of improving the combustion of a spark ignition engine, the engine having at least one cylinder, each cylinder having a combustion chamber and a piston that reciprocates within the combustion chamber, comprising:

locating an antenna within the combustion chamber;

providing an air-fuel mixture into the combustion chamber;

igniting the air-fuel mixture with an igniter, such that a combustion event occurs;

delivering an electromagnetic signal to the antenna;

wherein the antenna applies electromagnetic energy into the combustion chamber near the time of the combustion event;

adjusting, during the combustion event, the frequency of the electromagnetic energy in response to changing dimensions of the combustion chamber as the piston moves with the combustion chamber.

2. The method of claim 1, wherein the electromagnetic signal is a microwave signal.

3. The method of claim 1, wherein the electromagnetic signal is pulsed.

4. The method of claim 1, wherein the microwave signal is continuous.

5. The method of claim 1, wherein the locating step is performed by locating the antenna at the top of the piston.

6. The method of claim 1, wherein each cylinder has at least one intake or exhaust valve and wherein the locating step is performed by locating the antenna on a valve.

7. The method of claim 1, wherein each cylinder has a firing deck and wherein the locating step is performed by locating the antenna on the firing deck.

8. The method of claim 1, further comprising the step of controlling the frequency of the electromagnetic signal to in response to characteristics of the combustion event.

9. The method of claim 1, wherein the air-fuel mixture includes recirculated exhaust gas.

10. A piston cylinder for use in a spark-ignition engine in which an igniter is used to ignite an air-fuel mixture resulting in a combustion event, comprising:

a combustion chamber; a piston operable to move reciprocally within the combustion chamber; at least one intake valve;

at least one exhaust valve; an antenna located within the combustion chamber;

electromagnetic generator located outside the combustion chamber, in electrical connection with the antenna, and operable to deliver an electromagnetic signal to the antenna;

wherein the antenna is operable to radiate electromagnetic energy into the combustion chamber near the time of the combustion event;

wherein the electromagnetic generator is programmed to adjust, during the combustion event, the frequency of the electromagnetic energy in response to changing dimensions of the combustion chamber as the piston moves with the combustion chamber.

11. The cylinder of claim 10, wherein the electromagnetic signal is a microwave signal.

12. The cylinder of claim 10, wherein the electromagnetic signal is pulsed.

13. The cylinder of claim 10, wherein the microwave signal is continuous.

14. The cylinder of claim 10, wherein the antenna is located at the top of the piston.

15. The cylinder of claim 10, wherein each cylinder has at least one intake or exhaust valve and wherein the antenna is located on a valve.

16. The cylinder of claim 10, wherein each cylinder has a firing deck and wherein the antenna is located on the firing deck.

17. The cylinder of claim 10, wherein the electromagnetic generator is programmed to control the frequency of the electromagnetic signal to in response to changing internal geometry of the combustion chamber.

* * * * *